United States Patent [19]

Hindemit

[11] 4,141,401

[45] Feb. 27, 1979

[54] SOFT CARRYING CASE

[76] Inventor: Arno R. Hindemit, 2054 Sheraton Dr., Santa Clara, Calif. 95050

[21] Appl. No.: 772,408

[22] Filed: Feb. 28, 1977

Related U.S. Application Data

[63] Continuation of Ser. No. 612,403, Sep. 11, 1975, abandoned.

[51] Int. Cl.[2] ..... B65B 11/00; A45C 11/00

[52] U.S. Cl. ..... 150/52 R; 224/5 H

[58] Field of Search ..... 224/47, 26 R, 26 D, 224/5 R, 5 H, 28 R, 28 B, 45 R, 5 V; 150/52 J, 52 R, 35, 1, DIG. 1, 0.5

[56] References Cited

U.S. PATENT DOCUMENTS

| | | | |
|---|---|---|---|
| 1,535,312 | 4/1925 | Hosking | 150/52 J |
| 2,290,307 | 7/1942 | Wicker | 150/52 J |
| 2,681,600 | 6/1954 | Heidecke | 150/52 J |
| 3,286,751 | 11/1966 | Dishart | 224/26 R |
| 3,295,576 | 1/1967 | Schmitt et al. | 150/52 J |
| 3,314,348 | 4/1967 | Lang | 150/52 J |
| 3,731,586 | 5/1973 | Meazza | 150/52 J |

*Primary Examiner*—Trygve M. Blix
*Assistant Examiner*—Kenneth Noland
*Attorney, Agent, or Firm*—F. D. LaRiviere

[57] ABSTRACT

A soft carrying case for battery-powered, hand-held calculators and the like, as described herein, prevents the user from turning on the calculator while that calculator is in the carrying case, and provides the user with a way of detecting when the calculator is on if inserted into the carrying case without first being turned off.

4 Claims, 3 Drawing Figures

SOFT CARRYING CASE

This is a continuation of application Ser. No. 612,403, filed Sept. 11, 1975 now abandoned.

BACKGROUND & SUMMARY OF THE INVENTION

Soft carrying cases for battery-powered, hand-held calculators are known in the prior art. Such battery-powered calculators, as well as other battery-powered devices such as cassette tape recorders, frequently include miniature or micro-miniature power-on switches which are easily, though inadvertently, actuated through the soft fabric or other pliable material of the carrying case. Thus, a user may unknowingly carry his device around while uselessly depleting its batteries of their power. In addition, the user may inadvertently enclose his device in its respective carrying case without first turning it off, thus continuing to deplete the battery power after use.

A carrying case constructed according to the preferred embodiment of the present invention provides a substantially transparent, non-pliable insert positioned on the carrying case to correspond to the position of the power-on switch of the device when enclosed therein. The insert, being non-pliable, precludes the power-on switch from being inadvertently actuated. Since the insert is also substantially transparent, the position of the power-on switch can be observed by the user. If large enough to also include any illuminated read-out of the calculator or other indicator of power-on status, the user may not have to rely on observation of the position of the power-on switch but, rather, can determine whether the device is on from observing the illuminated read out.

DESCRIPTION OF THE PREFERRED EMBODIMENT

Figure 1:
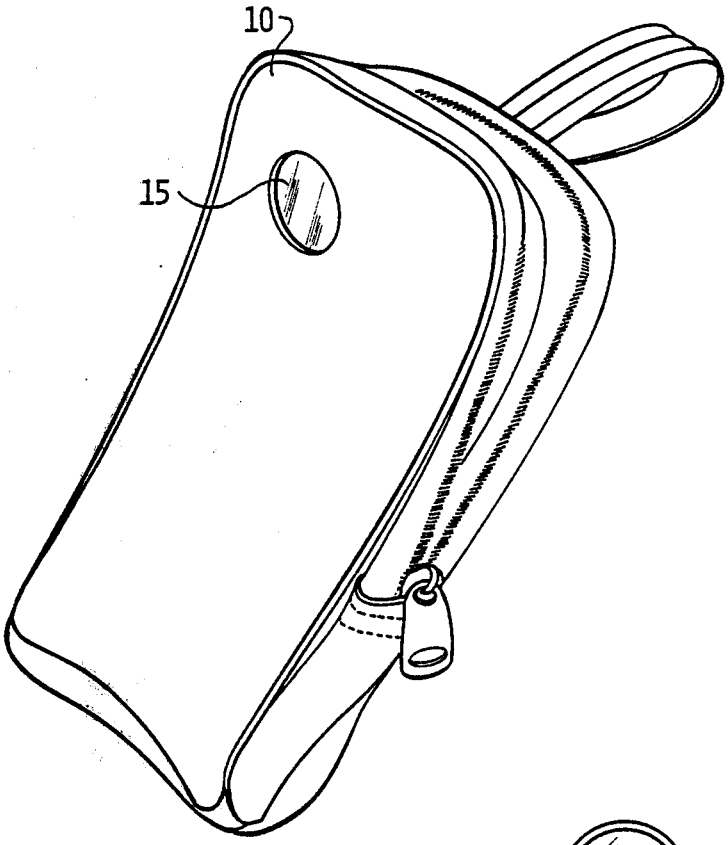
FIG. 1 is the perspective view of a soft carrying case constructed according to the preferred embodiment of the present invention.

Referring to FIG. 1, carrying case 10 is formed of soft, pliable, resilient material such as leather or vinyl to accommodate a hand-held, battery-powered calculator it encases, and includes non-pliable substantially transparent insert 15. The position of insert 15 is determined to correspond to the location of the power-on switch on the calculator when enclosed therein. The actual shape of carrying case 10 is not critical to practice this invention except that the entire case or at least the inside shape thereof should conform substantially to the contours of the device it encloses such that 1) there is only one case-to-device orientation, or 2) there is a plurality of inserts, for example, insert 13, positioned on the carrying case to correspond to the locations that the power-on switch of the device can have for all possible case-to-device orientations.

Figure 2A:
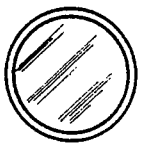
FIG. 2*a* is a top view of the insert for the soft carrying case of FIG. 1.

While the peripheral shape of the insert is also not critical to practice this invention, insert 15 has a substantially circular peripheral shape as shown in FIG. 2A.

Figure 2B:
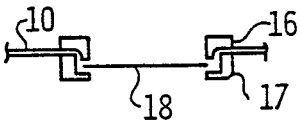
FIG. 2B is a cross-sectional view of the insert of FIG. 2A.

Referring now to FIG. 2B, inserts 13 and 15 comprise window 18 sandwiched between rings 16 and 17 which are held together by compression fit, the interference being between the outside diameter of ring 16 and the inside diameter of ring 17. The case material around the periphery of an opening therein to receive the insert is also clamped by rings 16 and 17, thereby holding the insert firmly in place.

I claim:

1. In combination, a portable, battery-powered electronic device having a power-on switch, and a carrying case of soft pliable material conforming substantially to the contours of the device and having a non-pliable, transparent insert positioned on the case to correspond to the location of the power-on switch of the device when that device is enclosed in the carrying case, said insert preventing interference of the carrying case with the power-on switch to preclude inadvertent actuation thereof when the device is enclosed in the carrying case.

2. The combination as in claim 1 wherein the carrying case includes a plurality of inserts positioned on the case to correspond to the locations that the power-on switch of the device can have for all possible case-to-device orientations.

3. The combination as in claim 1 wherein the insert includes a transparent plate sandwiched between two rings for holding said plate firmly therebetween:

said rings being held together by interference fit of the inside diameter of one of said rings with the outside diameter of the other of said rings;

the material around the periphery of an opening in the case to receive the insert also being sandwiched between said two rings for holding the insert firmly in place on the case.

4. The combination as in claim 1 wherein the position of the power-on switch of the device is observable through the non-pliable insert when that device is enclosed in the case.

* * * * *